US012704316B1

(12) United States Patent
Schaffler

(10) Patent No.: US 12,704,316 B1
(45) Date of Patent: Aug. 11, 2026

(54) REFRIGERATOR TRIM KIT AND METHOD OF ITS USE

(71) Applicant: Samuel Aubin Schaffler, Tulsa, OK (US)

(72) Inventor: Samuel Aubin Schaffler, Tulsa, OK (US)

( * ) Notice: Subject to any disclaimer, the term of this patent is extended or adjusted under 35 U.S.C. 154(b) by 5 days.

(21) Appl. No.: 18/947,782

(22) Filed: Nov. 14, 2024

Related U.S. Application Data

(63) Continuation-in-part of application No. 17/745,510, filed on May 16, 2022, now abandoned.

(60) Provisional application No. 63/188,827, filed on May 14, 2021.

(51) Int. Cl.
*F25D 23/06* (2006.01)
*A47B 96/20* (2006.01)

(52) U.S. Cl.
CPC ..... *F25D 23/065* (2013.01); *A47B 96/20* (2013.01); *A47B 2096/208* (2013.01)

(58) Field of Classification Search
CPC .. F25D 23/065; A47B 96/20; A47B 2036/208
See application file for complete search history.

(56) References Cited

U.S. PATENT DOCUMENTS

| | | | | |
|---|---|---|---|---|
| 2,888,684 | A | 6/1959 | Icenhower | |
| 3,352,615 | A | 11/1967 | Sandin | |
| 4,935,593 | A | 6/1990 | Nishikawa | |
| 5,265,954 | A | 11/1993 | Keil | |
| 5,286,940 | A | 2/1994 | Leeds | |
| 5,385,703 | A * | 1/1995 | Shanok | B29C 48/12 264/173.17 |
| 7,665,810 | B2 | 2/2010 | Crompton et al. | |
| 8,182,051 | B2 | 5/2012 | Laible et al. | |
| 8,215,726 | B1 | 7/2012 | Klassen | |
| 9,474,431 | B2 | 10/2016 | Patil et al. | |
| 10,012,430 | B2 | 7/2018 | Akalan et al. | |
| 2003/0230955 | A1 | 12/2003 | Welch | |
| 2004/0129183 | A1 | 7/2004 | Owen | |
| 2008/0036350 | A1 * | 2/2008 | Crompton | F25D 23/02 312/405 |
| 2009/0261703 | A1 | 10/2009 | Kentner et al. | |

FOREIGN PATENT DOCUMENTS

| | | | |
|---|---|---|---|
| CN | 207778936 | U | 8/2018 |
| DE | 3537121 | A1 | 4/1987 |
| DE | 202008005354 | U1 | 8/2008 |
| DE | 102021205363 | A1 | 12/2022 |
| KR | 20050019253 | | 3/2005 |
| KR | 2005100231 | A | 10/2005 |
| KR | 20050113049 | A | 12/2005 |
| KR | 20080062782 | A | 7/2008 |
| KR | 20110054979 | A | 5/2011 |

* cited by examiner

*Primary Examiner* — Elizabeth J Martin
(74) *Attorney, Agent, or Firm* — GableGotwals

(57) ABSTRACT

A conversion trim kit of this disclosure is adapted for use with a refrigerator, a refrigerator/freezer, or a stand-alone upright freezer that, in a connected state, attach to cabinetry surrounding the appliance rather than the appliance itself. The kit includes a top trim panel that includes a backing plate with slots and louvers with tabs adapted for insertion into the slots. After insertion into the slot, the tab is sheared and crimped, thereby tightly joining the louver to the backing plate without the need for welding.

6 Claims, 18 Drawing Sheets

REFRIGERATOR TRIM KIT AND METHOD OF ITS USE

CROSS-REFERENCE TO CO-PENDING APPLICATIONS

This application is a continuation-in part of, and claims priority to, U.S. Ser. No. 17/745,510 filed May 16, 2022, which in turn claimed priority to U.S. 63/188,827 filed May 14, 2021.

BACKGROUND

This disclosure in in the field of trim kits and, in particular, trim kits intended for use in an existing refrigerator, refrigerator-freezer, or stand-alone upright freezer installations.

A refrigerator trim kit is a set of decorative metal trim panels which are installed around a refrigerator to give it a built-in look. Prior art refrigerator trim kits are brand specific and mount to the appliance and not to the surrounding cabinetry.

SUMMARY

Trim kits of this disclosure are not brand specific and mount to cabinetry surrounding the refrigerator, refrigerator-freezer, or stand-alone upright freezer. The trim kit may be specified for a new installation or retrofit of an existing installation. In embodiments, the trim kit is not suitable for use with built-in microwave installations.

A trim kit of this disclosure and method of use include a trim kit having a top trim panel and a pair of side trim panels, the top and the pair of side trim panels being independent pieces not connected one to the other. The top trim panel is adapted for connection to a horizontal run of a cabinet and may have a height in a range of 25 to 360 mm and a width in a range of 600 to 2000 mm. Each side trim panel of the pair is adapted for connection to a corresponding one of a vertical run of the cabinet and may have a height in a range of 600 to 2150 mm and a width in a range of 12 to 160 mm. Fasteners such as threaded screws are used to connect the trim kit to the cabinet rather than to the refrigerator. When in a connected state to the cabinet, the top trim panel covers at least a portion of a gap between a top end of the refrigerator or a stand-alone upright freezer and the horizontal run of the cabinet and each side trim panel covers at least a portion of a corresponding gap between a side edge of the refrigerator and the vertical run of the cabinet. The refrigerator may be a stand-alone refrigerator or also include a top, side, or bottom freezer.

In embodiments a trim kit of this disclosure for creating a finished, built-in look around a residential kitchen appliance by connecting to cabinetry surrounding the residential kitchen appliance, the residential kitchen appliance being selected from the group consisting of a refrigerator, a refrigerator-freezer, and a stand-alone upright freezer, the trim kit comprises a top trim panel having a front cosmetic surface face, a rear face opposite the front cosmetic face, and a flange perpendicular to, and running widthwise across, the rear face, the flange including a plurality of fastener holes; the top trim panel having a predetermined height and width, the predetermined height being selected to be less than a height of a top gap between the residential kitchen appliance and a horizontal run of cabinet above the residential kitchen appliance. The trim kit further includes a pair of side trim panels, each side trim panel having a front cosmetic face surface and including a flange running lengthwise and arranged perpendicular to the front cosmetic surface face, the flange including a plurality of fastener holes, each side trim panel having a predetermined height and width, the predetermined width of each side trim panel being selected to be less than a width of a side gap between a side of the residential kitchen appliance and a vertical run of cabinet beside the residential kitchen appliance.

In some embodiments, the top trim panel has a predetermined height in a range of 25 to 360 mm and a predetermined width in a range of 600 to 2000 mm. Each side panel may have a predetermined height in a range of 600 to 2150 mm and a predetermined width in a range of 12 to 160 mm. A set of instructions for sizing the top and side trim panels and for connecting the top and side trim panels to the horizontal and vertical runs of cabinets may be provided.

In embodiments of a method for creating a finished, built-in look by closing a top and side gap between a residential kitchen appliance and cabinetry surrounding the residential kitchen appliance, the method comprises providing the trim kit and connecting the top trim panel and the pair of side panels only to the cabinetry and not to one another or to the residential kitchen appliance. Once the trim kit is connected to the cabinet run, the residential kitchen appliance may be moved into or out of the cabinetry without disconnecting the connected top trim panel and the pair of side panels.

In other embodiments of this disclosure, a top trim panel includes louvers having tabs extending rearwardly and a backing plate with slots for receiving the tabs. After insertion into the slot, the tab is sheared and crimped oblique to the backing plate, thereby preventing the tab's escape from the slot and tightly joining louver to the backing plate. No welding is required for joining a stainless steel louver to the backing plate. A same tab-and-slot arrangement can be used to join other pairs of components together.

DESCRIPTION

Figure 1A:
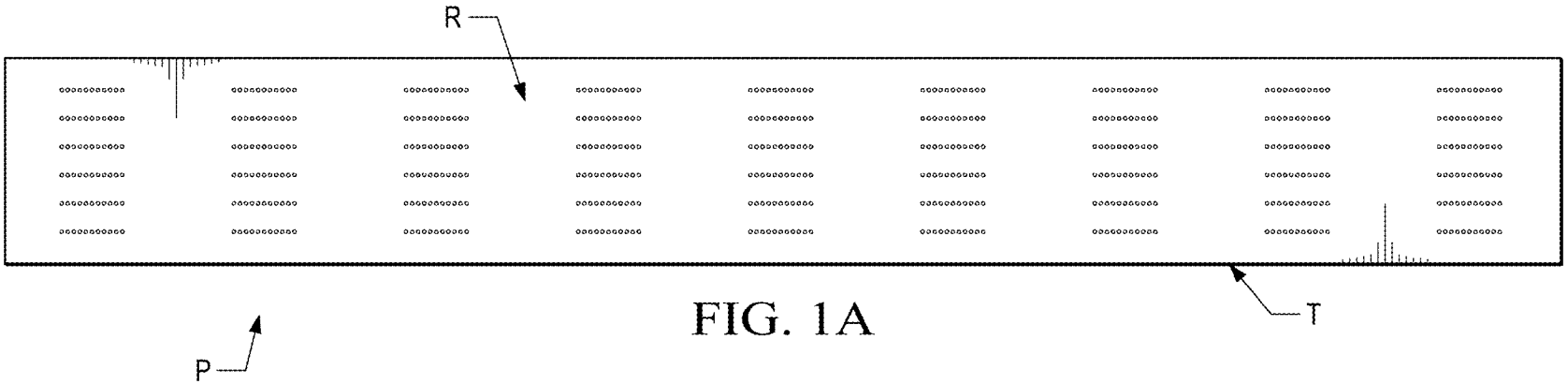
FIG. 1A is a rear elevation view of an embodiment of a top trim panel of a trim kit of this disclosure. This view is not to scale and is provided to help illustrate a ventilation hole pattern that may be included on a finished part.
Figure 1C:
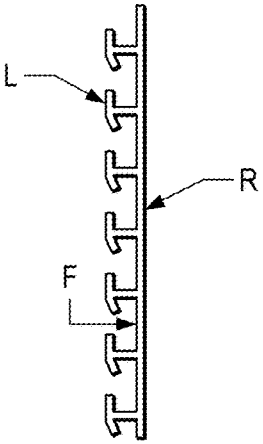
FIG. 1C is a side elevation view of the top trim panel of FIG. 1B.
Figure 1B:
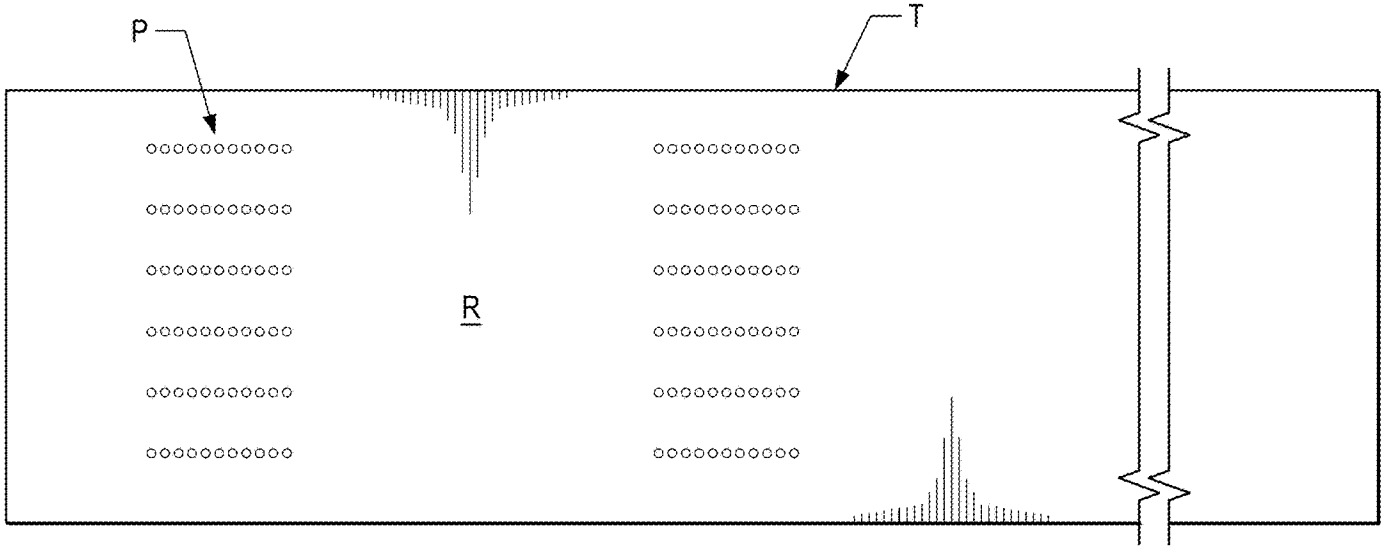
FIG. 1B is another rear elevation view of an embodiment of a top trim panel of this disclosure. A predetermined ventilation hole pattern may repeat at predetermined intervals along the width of the top trim panel. The hole pattern is hidden behind the louvers shown in FIGS. 1C, 2A and 2B.
Figure 2A:
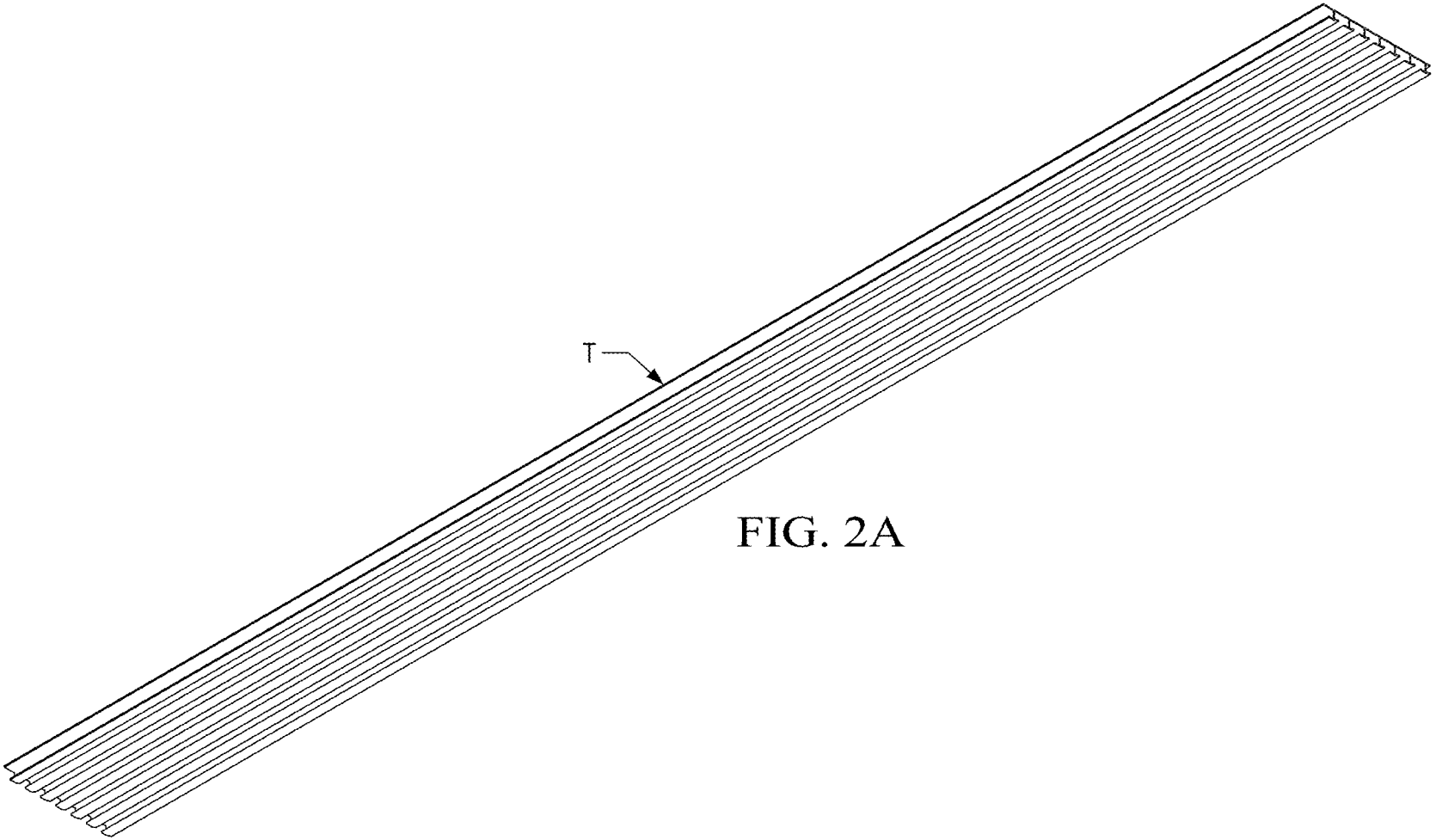
FIG. 2A is an isometric view of the top trim panel of FIG. 1B.
Figure 2B:
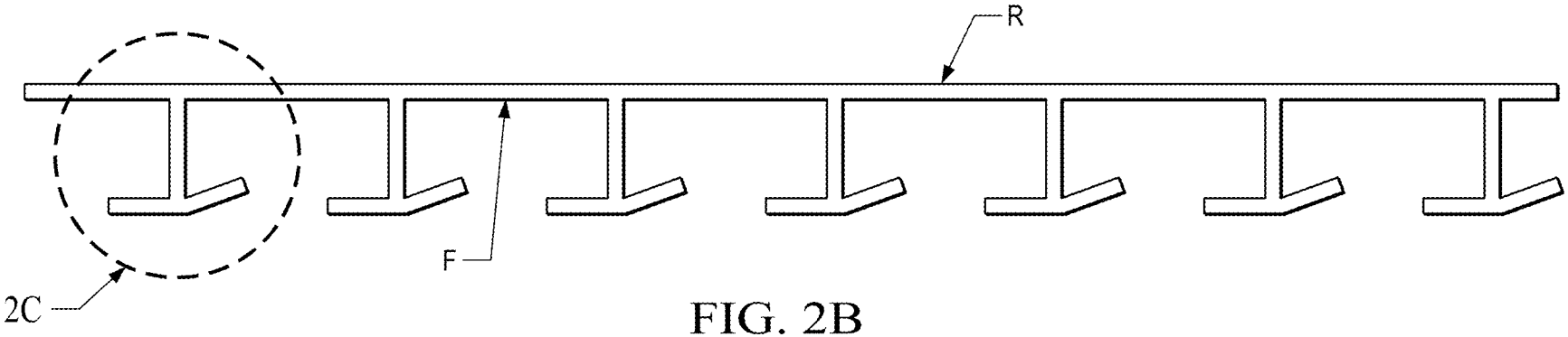
FIG. 2B is a top plan view of the top trim panel.
Figure 2C:
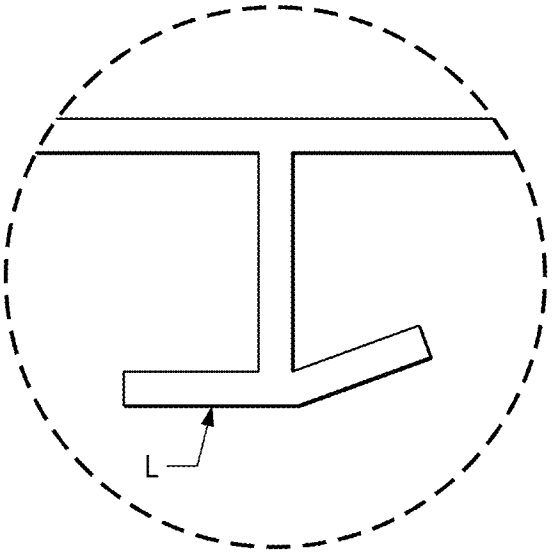
FIG. 2C is an enlarged top plan view of detail 2C of FIG. 2B.
Figure 3A:
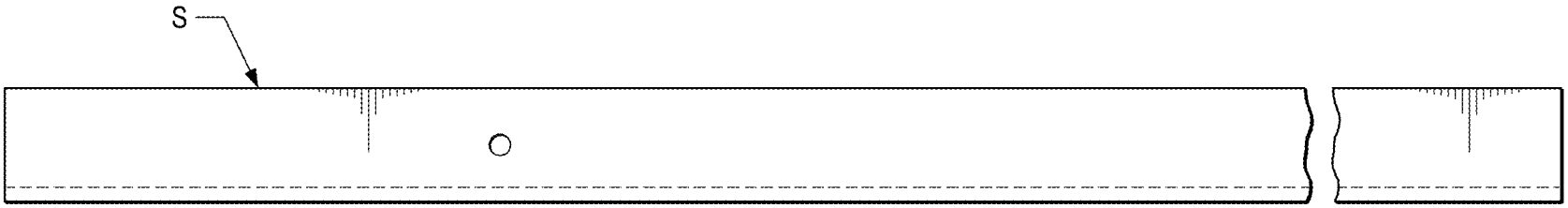
FIG. 3A is a front elevation view of an embodiment of a side trim panel of this disclosure.
Figure 3B:
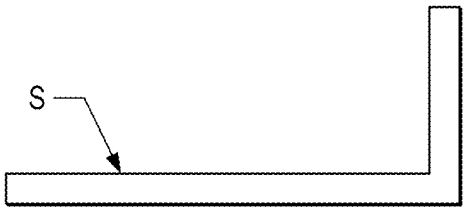
FIG. 3B is a side elevation view of the side trim panel of FIG. 3A.
Figure 4A:
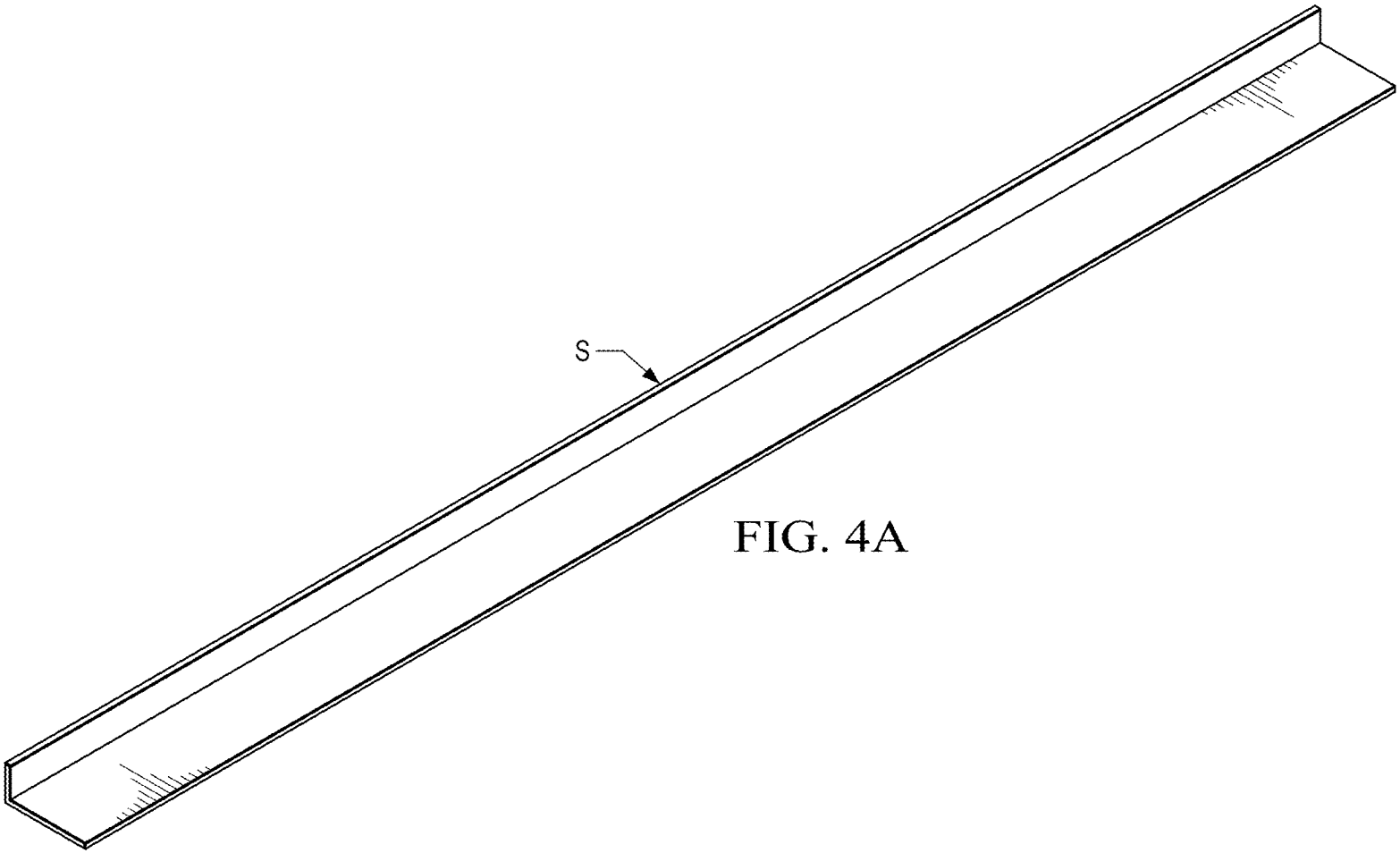
FIG. 4A is an isometric view of the side trim panel of FIG. 3A.
Figure 4B:
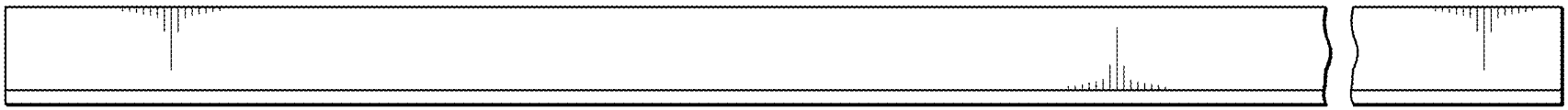
FIG. 4B is top plan view of the side trim panel of FIG. 3A.
Figure 4C:
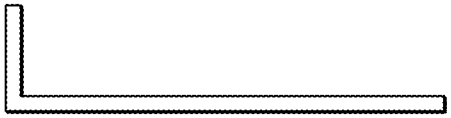
FIG. 4C is another side elevation view of the side trim panel of FIG. 3A.
Figure 5:
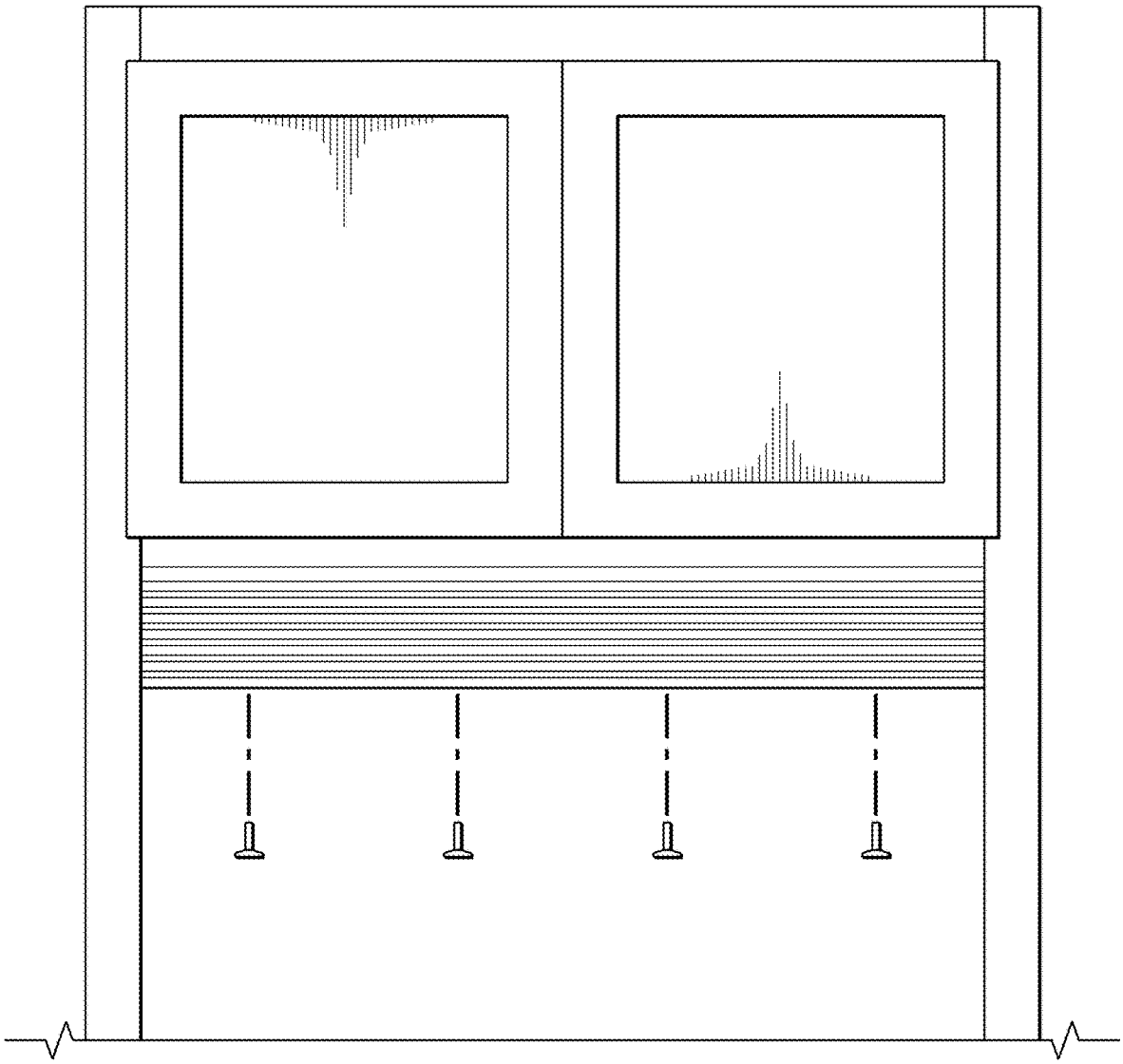
FIG. 5 is a schematic of a method for installing a top trim panel of a trim kit of this disclosure to a cabinet run located above a refrigerator or stand-alone upright freezer.
Figure 6A:
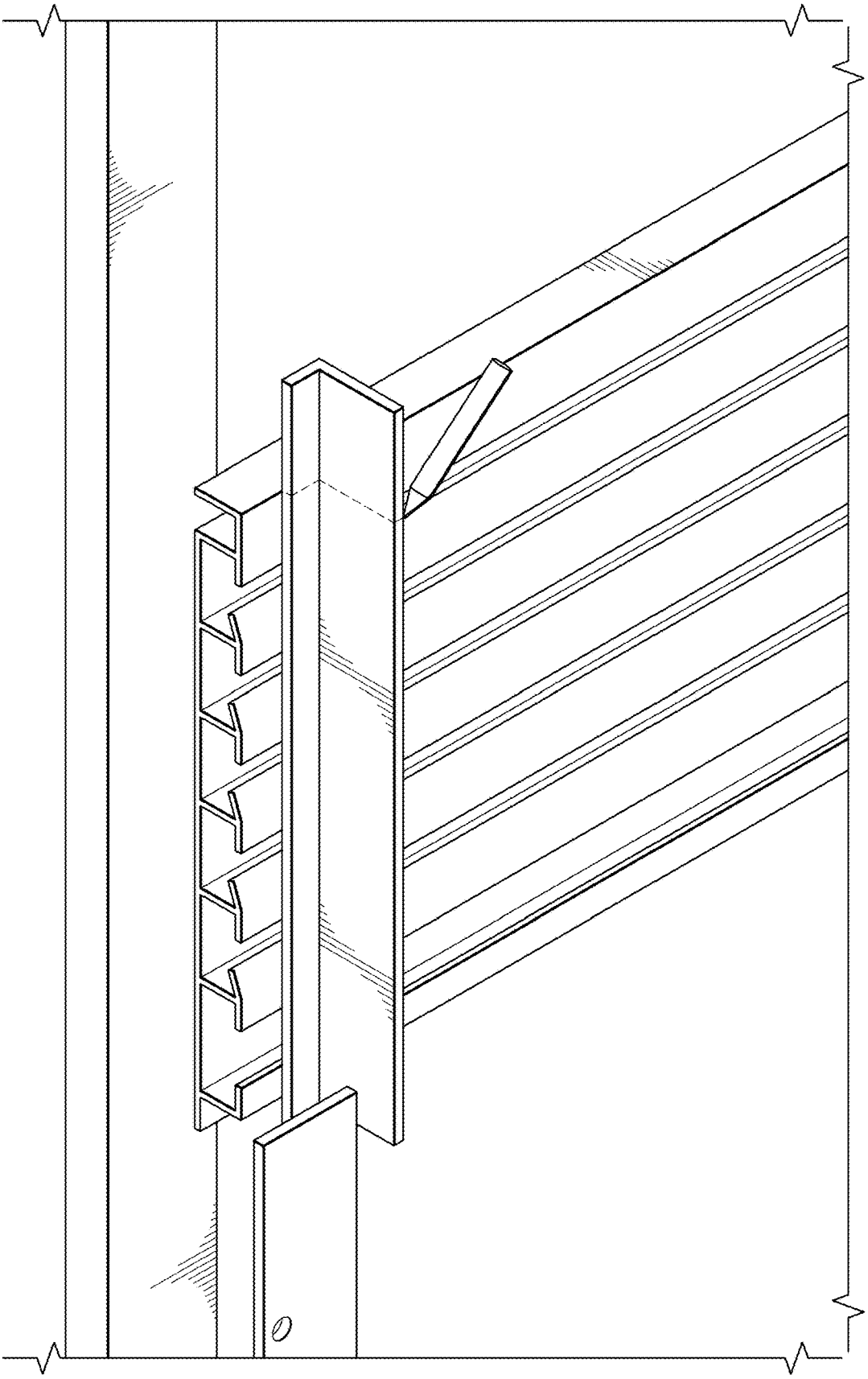
FIG. 6A is a schematic of a method for installing a left side trim panel of the trim kit to a cabinet run located to the left of the refrigerator or stand-alone upright freezer.
Figure 6B:
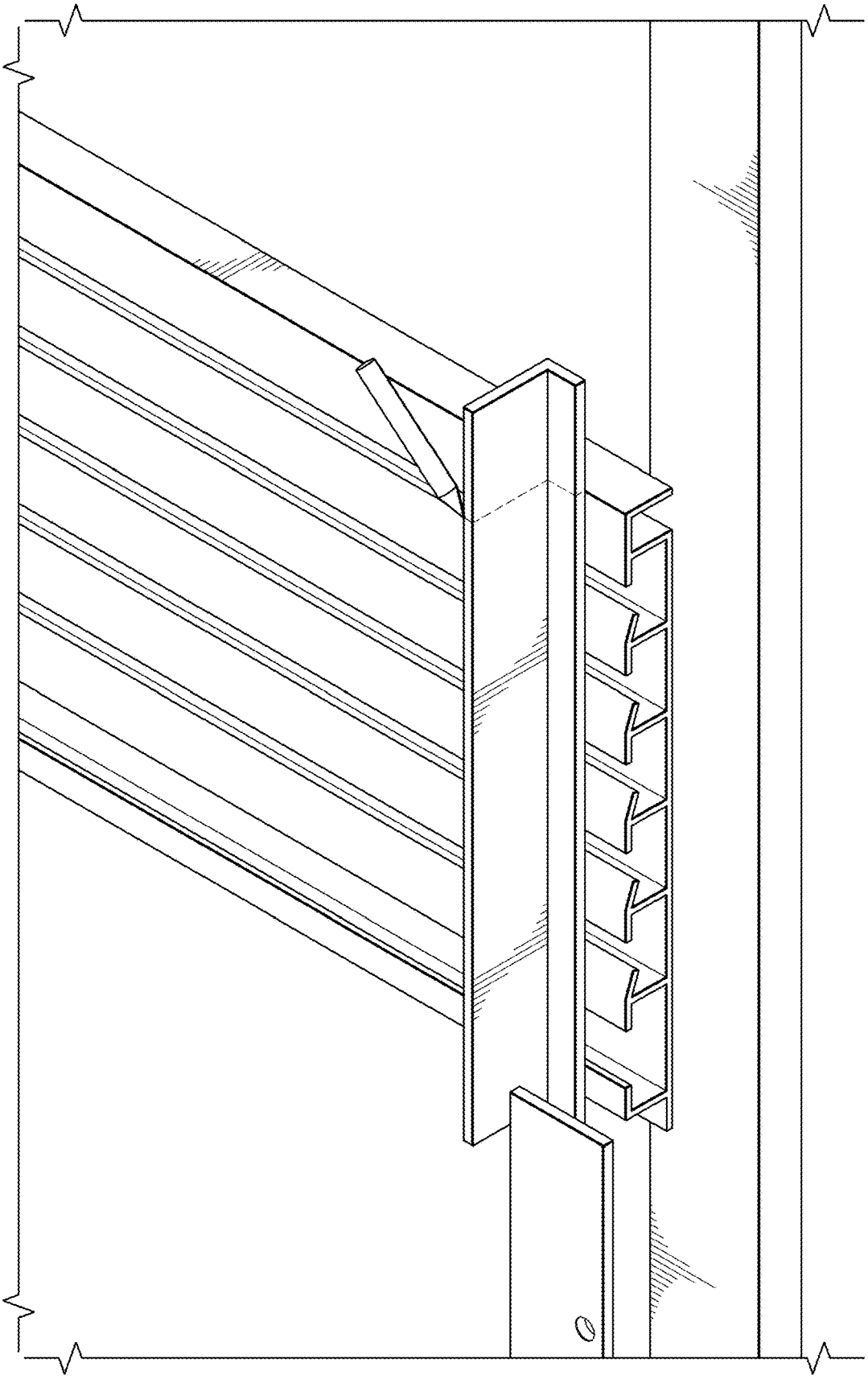
FIG. 6B is a schematic of a method for installing a right side trim panel of the trim kit to a cabinet run located to the right of the refrigerator or stand-alone upright freezer.
Figure 7A:
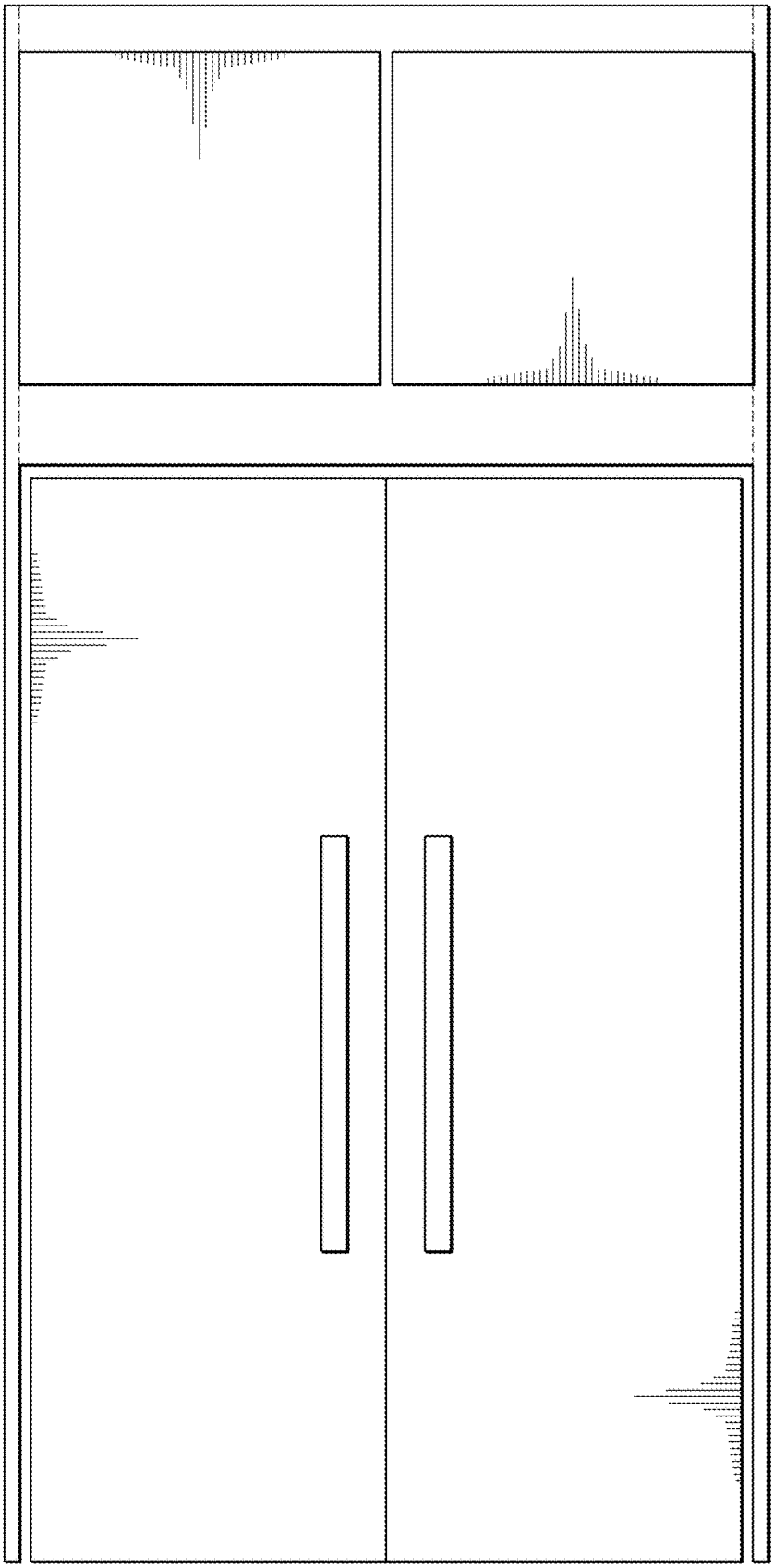
FIG. 7A is an example specification sheet used in the embodiments of this disclosure. Example clearance dimensions for use when building cabinets about the refrigerator or stand-alone upright freezer are provided.
Figure 7C:
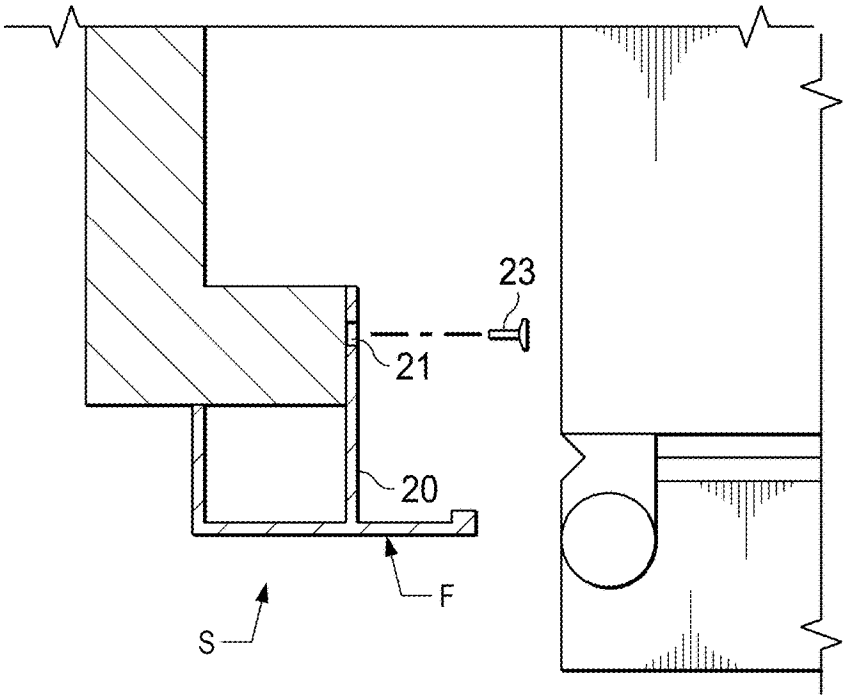
FIG. 7C is an example portion of a specification sheet showing a top view of the side trim panel details (again not to scale).
Figure 7B:
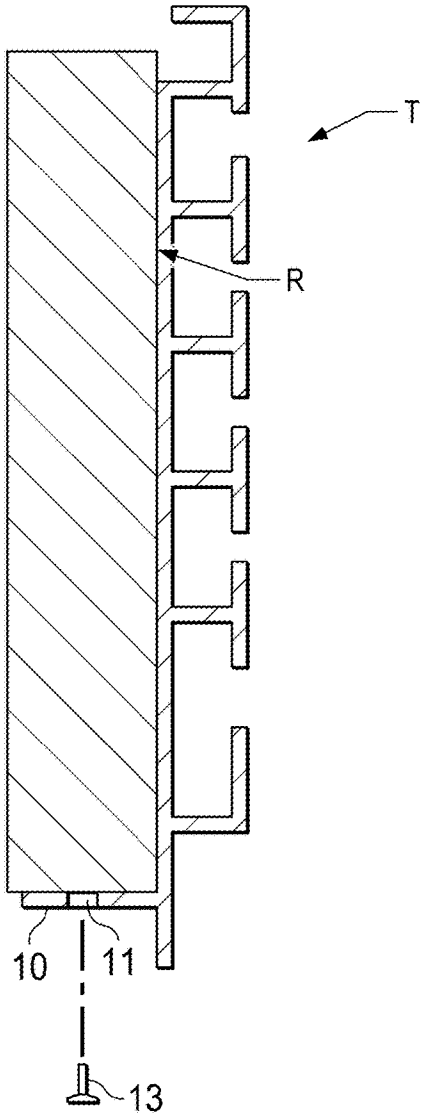
FIG. 7B is an example portion of a specification sheet showing a side view of the top trim panel details (not to scale).
Figure 8:
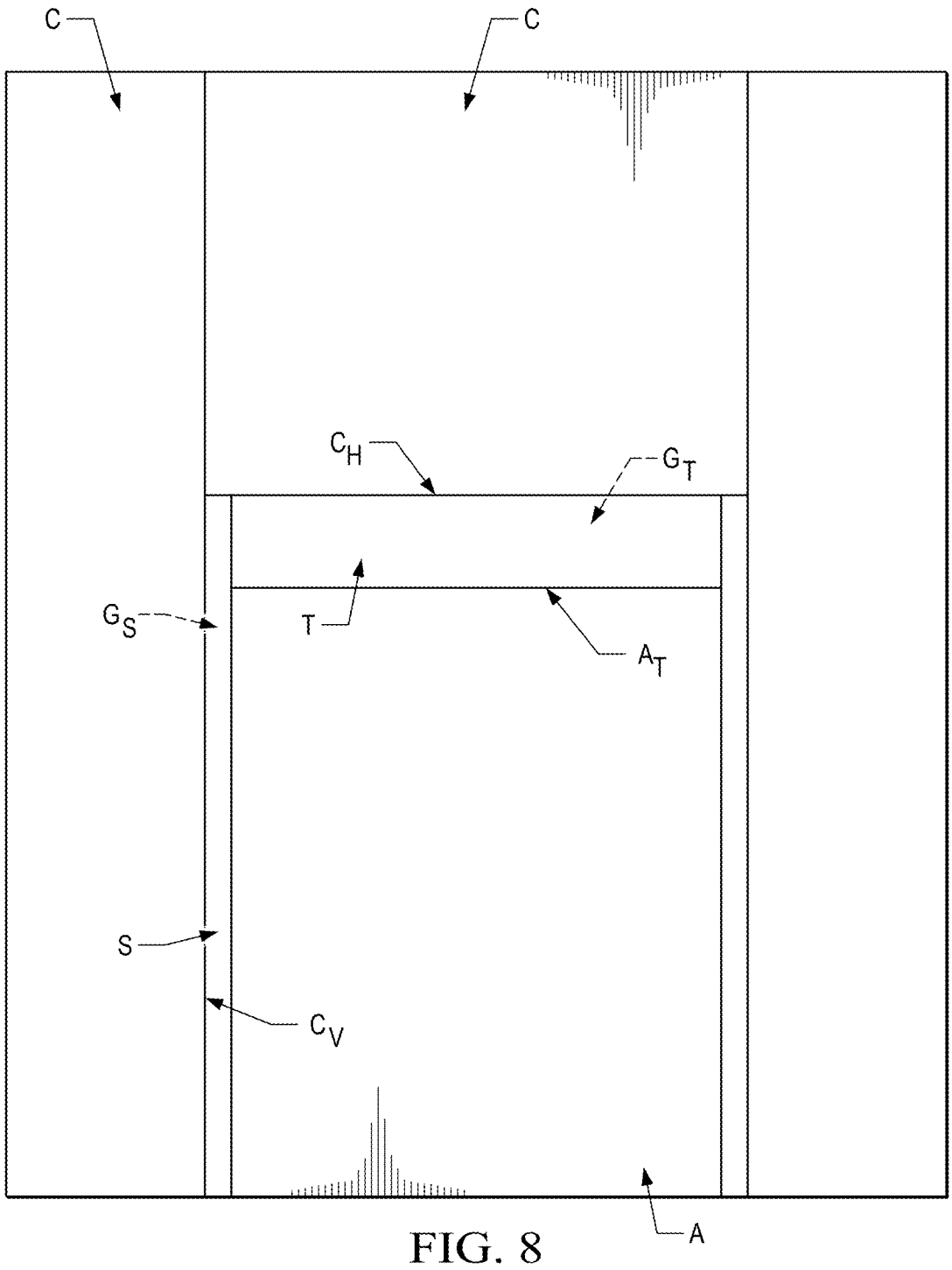
FIG. 8 is a schematic of an appliance having a trim kit of this disclosure and installed within an opening of a cabinet run. When installed, the trim kit is independent of the cabinet run and the appliance may be removed from the opening with the trim kit remaining connected to the appliance.
Figure 9A:
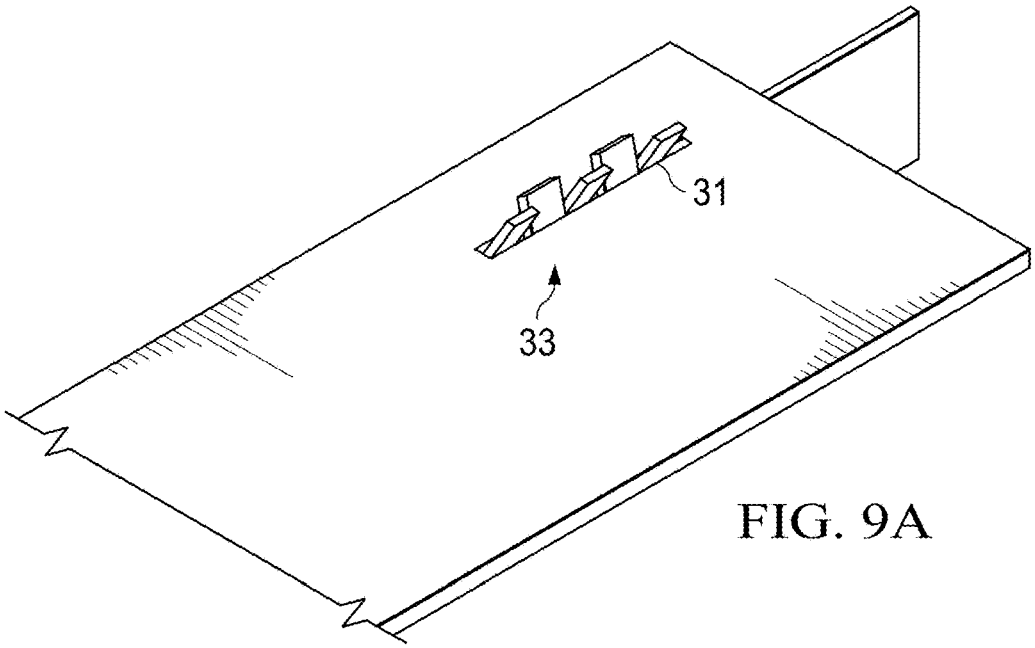
FIG. 9A is an isometric rear view of joining of two panels of the trim kit. Only an upper end of the panels are shown. Tabs of one panel are inserted into corresponding slot of the other panel and, after insertion, the tab is sheared and adjacent tab sections are bent or crimped so they lie oblique to the other panel, thereby preventing their escape from the slot.
Figure 9B:
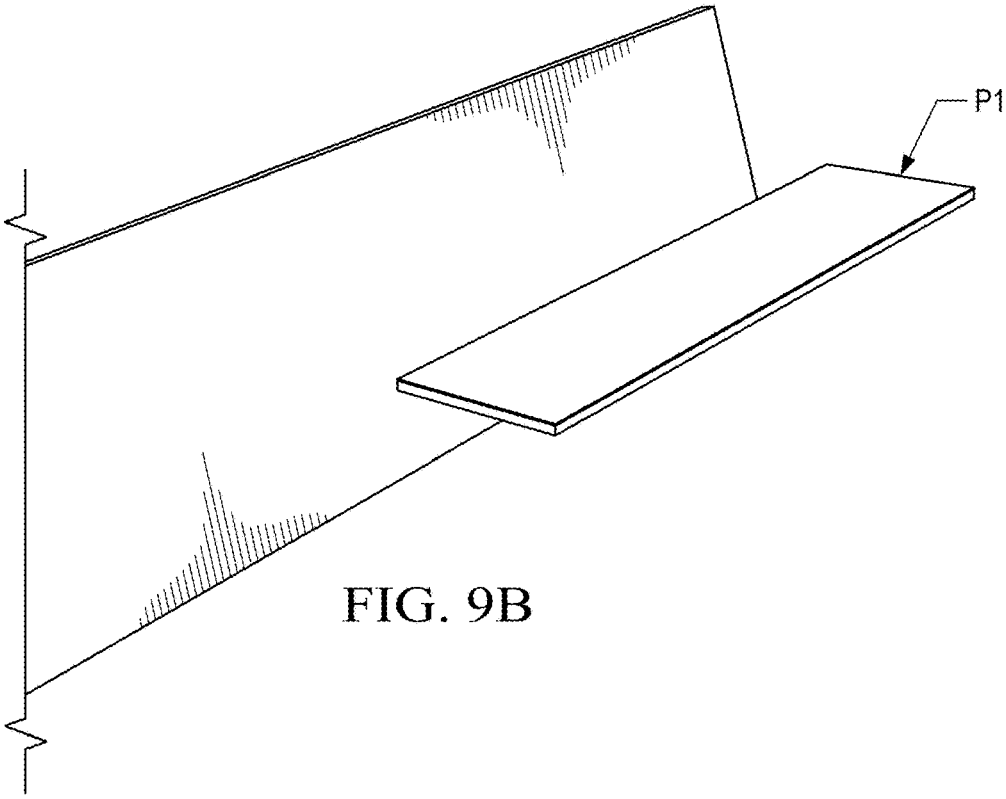
FIG. 9B is isometric front and side view of the joined panels.
Figure 9C:
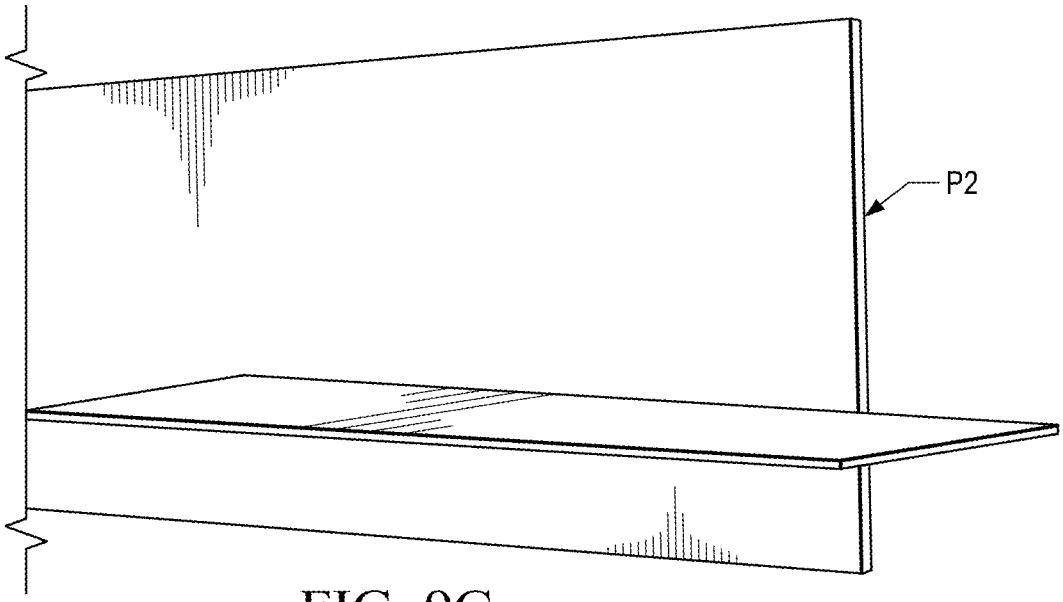
FIG. 9C is another isometric view of the joined panels.
Figure 9D:
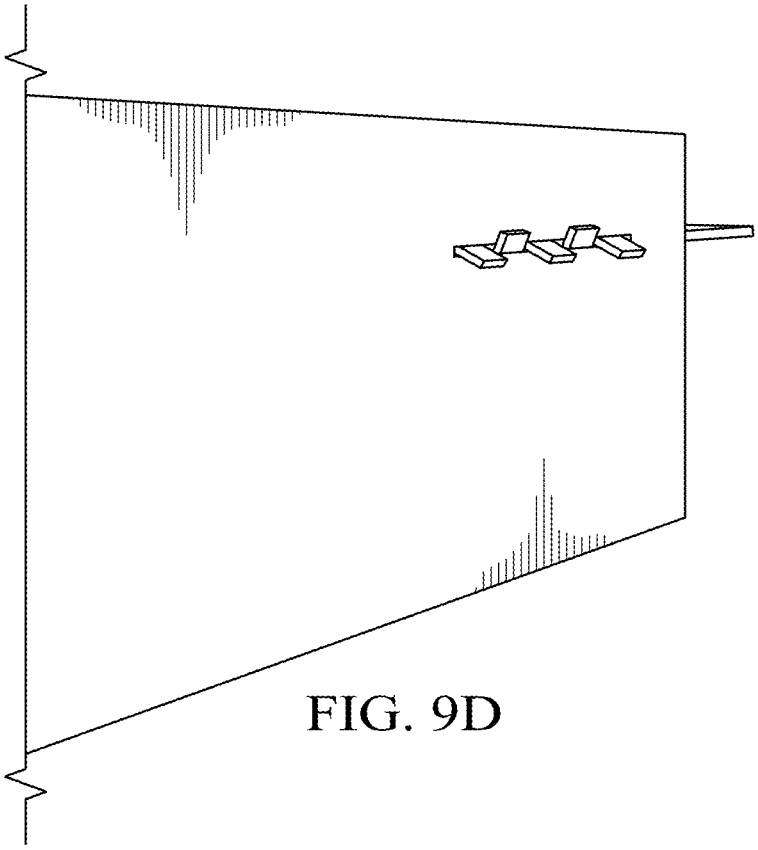
FIG. 9D is another isometric rear view of the tabs as they extend through the slot.
Figure 10:
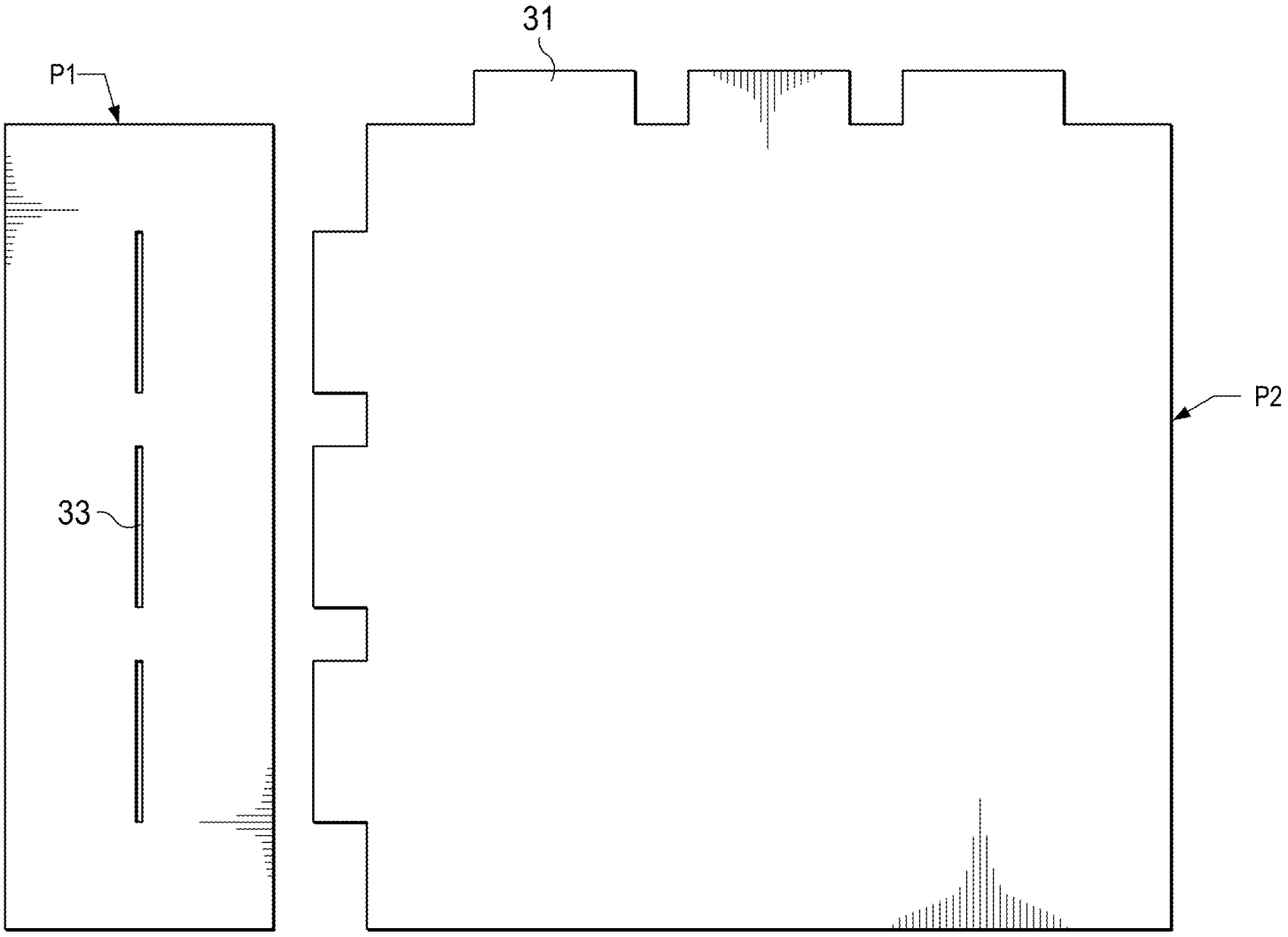
FIG. 10 is a schematic illustrating tabs of one panel and corresponding slots of another panel for receiving the tabs. In some embodiments, multiple tabs may be received by a single slot and, after insertion, bending or crimping adjacent tabs in opposite directions. The multiple tabs may be created by shearing after insertion.
Figure 11:
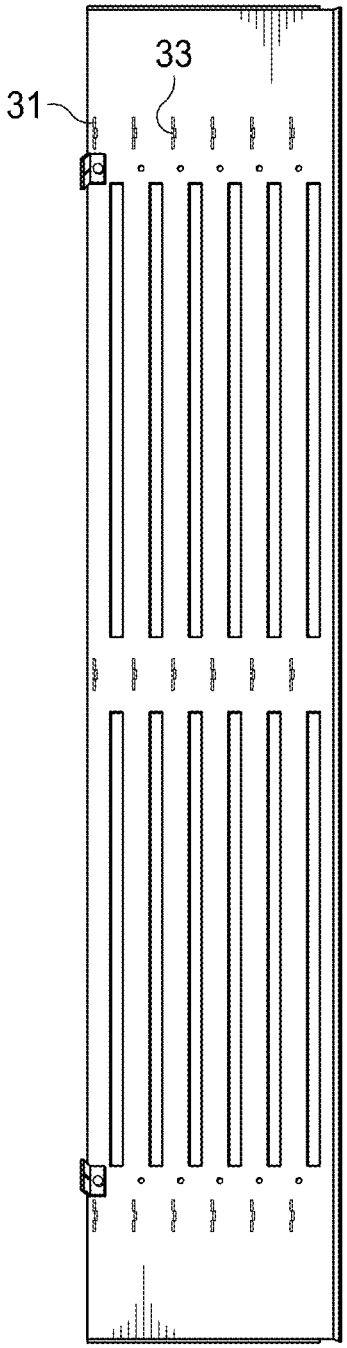
FIG. 11 is a rear elevation view of a top trim panel of this disclosure. Tabs of a front face extend through the slots of a rear face and arranged oblique to a backing plate to prevent their escape, thereby joining the louver to the backing plate without welding. Unlike the embodiment of FIG. 1C, in which the louvers are an extruded aluminum part, the louvers of this embodiment can be stainless steel and joined to a backing plate as an assembly without the need for welding.
Figure 12:
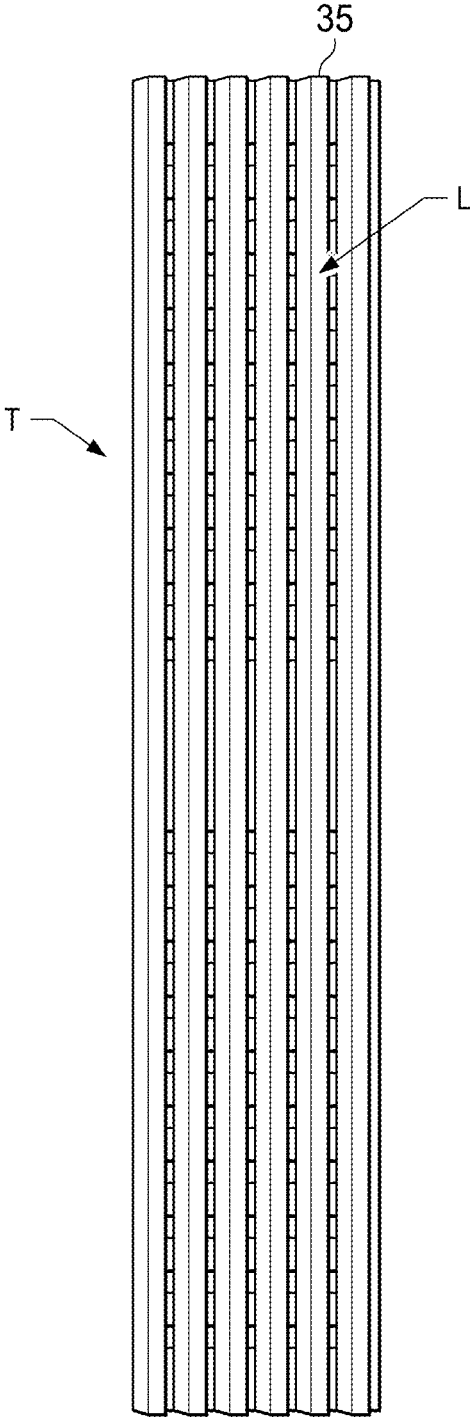
FIG. 12 is a front elevation view of the top trim panel of FIG. 11.
Figure 13:
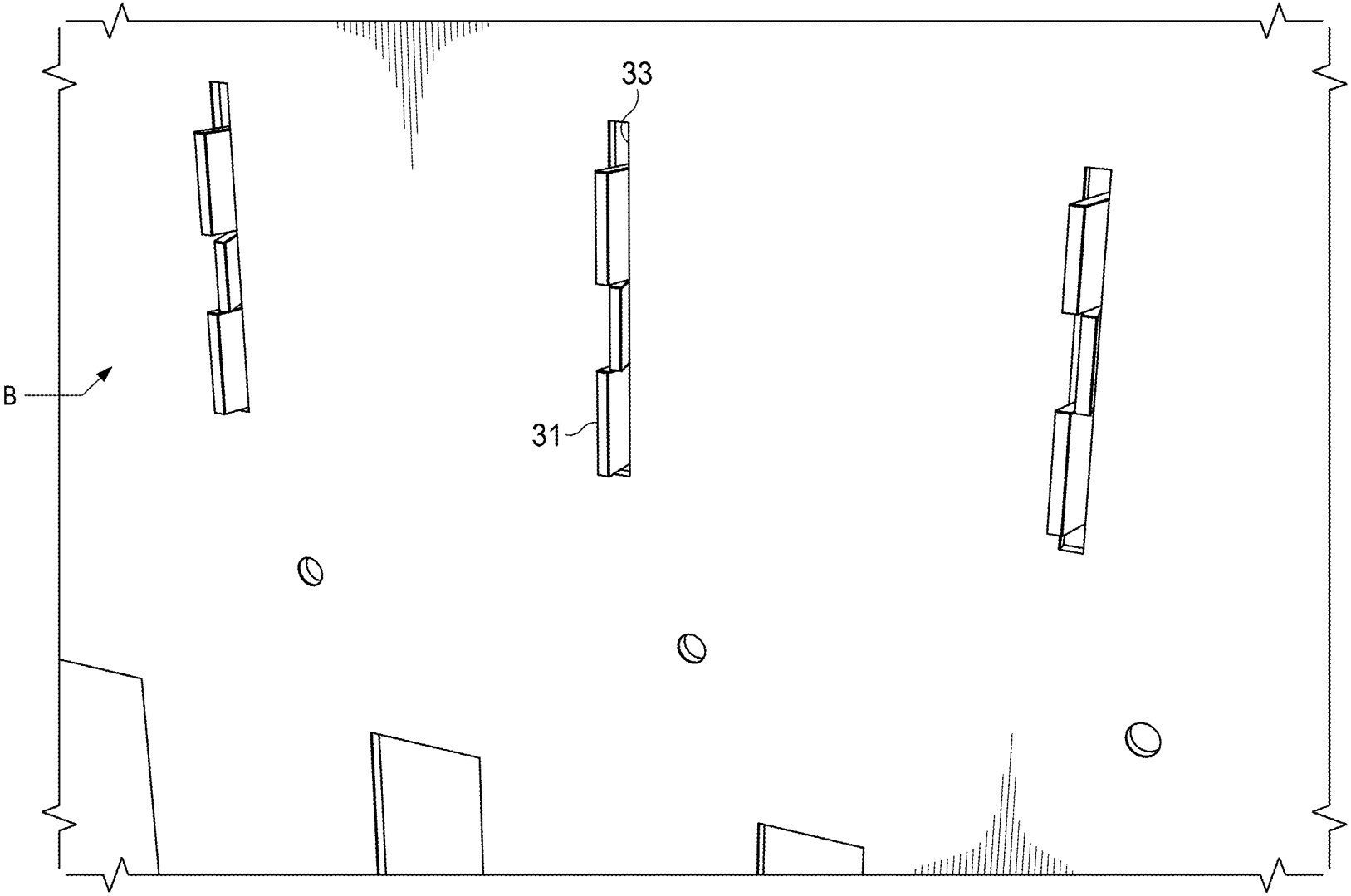
FIG. 13 is an enlarged, partial rear elevation view of the top trim panel of FIG. 11.

Embodiments of this disclosure include a trim kit comprising a top trim panel T arranged for connection to a horizontal run of a cabinet and, when in a connected state to the cabinet, covering at least a portion of a gap between a top end of a refrigerator, refrigerator/freezer, or stand-alone upright freezer and the horizontal run of the cabinet; and a pair of side trim panels S each arranged for connection to a corresponding one of a vertical run of the cabinet and, when in a connected state to the cabinet, covering a least a portion of the gap between a side edge of the refrigerator, refrigerator/freezer, or stand-alone upright freezer and the vertical run of the cabinet. The top trim panel T may include a ventilation hole pattern P along a rear or rearward-facing side R and a series of louvers L that appear as decorative rails (and corresponding channels between adjacent rails) along a front or forward-facing cosmetic surface side F which hide the hole pattern P. The top trim panel T includes a flange 10 arranged perpendicular to the rearward-facing side R and running widthwise. The flange 10 has fastener holes 11 for receiving sized for receiving fasteners 13 that will connect the panel T to the horizontal run of the cabinet. The side trim panel S may be L-shaped and flat along its front and side faces. The side trim panel S includes a flange 20 running lengthwise that has fastener holes 21 sized for receiving fasteners 23 that will connect the panel S to a vertical run of the cabinet. The trim kit is independent of the refrigerator, refrigerator/freezer, or stand-alone upright freezer, being connected to the cabinets by threaded fasteners and not connected to the appliance. The fasteners 13 connect the top trim panel T to the horizontal cabinet run without penetrating the forward-facing cosmetic surface F of the trim panel T. This may be accomplished by installing the fasteners 13 vertically through a flange 10 across the rearward-facing side R of the trim panel T and into the bottom edge of the horizontal cabinet run. The same is true of the side trim panel S, where the fasteners 23 connect to the vertical run without penetrating a forward-facing cosmetic surface F of the side trim panel S.

A method of this disclosure closes a gap between a refrigerator or stand-alone upright freezer and a cabinet run surrounding the refrigerator, refrigerator/freezer, or stand-alone upright freezer, the method comprising providing a trim kit that includes the top trim panel T and the pair of side trim panels S and connecting the top and side trim panels of the trim kit only to the cabinet run by way of fasteners 13, 23 such as wood screws or the like. When in a connected state to the cabinet, the top trim panel T covers at least a portion of a gap GT between a top end Ar of the appliance A (refrigerator, refrigerator/freezer, or stand-alone upright freezer) and the horizontal run CH of the cabinet C and each side trim panel S covers a least a portion of the gap Gs between a corresponding side edge of the appliance A and the vertical run Cv of the cabinet C. The trim kit is independent of the appliance A, being connected to the cabinet by the fasteners and not connected to the appliance. Because the trim kit is independent of the refrigerator, the trim kit may be connected before the refrigerator is placed within the cabinet run, and, once the trim kit is connected to the cabinet run, the refrigerator may be removed for maintenance or cleaning without disturbing the trim kit.

In some embodiments of this disclosure, a first and a second panel (or plate or face surface) P1, P2 are arranged orthogonal to one another and joined using tabs 31. No welding is required. One of the panels P1 or P2 includes a plurality of the tabs 31 and another of the panels P2 or P1 includes a plurality of slots 33 arranged to receive the tabs 31. Each tab 31 is inserted into a corresponding one of the slots 33 and, after insertion, may be sheared in two places to create three tabs 31A, 31B, 31C and crimped so that each tab 31A, 31B, 31C lies oblique to the backing plate B. In other embodiments, more than three tabs may be created by shearing. The oblique angles of each crimped tab 31A, 31B, 31C may be the same or different. In some embodiments, and where three tabs are created, the end tabs 31A, 31C lie in one direction and the middle tab 31B lies in the opposite direction.

By way of a non-limiting example, panel P1 can be a louver L, with tabs 31 located toward each end 35 of the louver and extending rearward from the louver L, and panel P2 can be a backing plate B with the slots 31 spaced and sized to receive the tabs 31. The louver L is joined to the backing plate B by inserting the tabs 31 into a corresponding slot 33 and then, after the insertion, shearing and crimping the tabs 31 thereby preventing their escape from the slot 33 and joining the louver L and backing plate B tightly together. In some embodiments, shearing and crimping of the tab 31 may occur in a single step.

After shearing and crimping, at least one of the tabs 31A, 31B, 31C lie in one direction and another of the tabs 31A, 31B, 31C lie in an opposing direction.

The angle of the tab 31A, 31B, 31C after crimping is less than 90 degrees and may be in a range of 1 to 45 degrees, there being sub-ranges within this broader range as well as discrete values. Using a method of this disclosure, a top trim panel T with stainless steel louvers L can be joined to the backing plate B in less than a minute and in significantly less time than if welding were to be used.

What is claimed:

1. A top trim panel for a residential kitchen appliance, the top trim panel comprising:

a backing plate including a plurality of spaced-apart slots;

a front face having one or more louvers including a plurality of tabs extending rearward from the louvers and adapted for insertion into corresponding slots of the plurality of spaced-apart slots;

wherein each tab moves between a first orientation forward of, and normal to, the backing plate for insertion into a corresponding one of the spaced-apart slots and a second orientation rearward of, and oblique to, the backing plate after insertion into the corresponding one of the spaced-apart slots.

2. The top trim panel of claim 1, wherein within each slot at least one pair of adjacent tabs angle in a different direction from one another.

3. The top trim panel of claim 1, wherein adjacent tabs are spaced-apart from one another.

4. The top trim panel of claim 1, wherein adjacent tabs are separated by a break line.

5. The top trim panel of claim 1, further comprising a flange perpendicular to, and running widthwise across, a rear face of the top trim panel, the flange including a plurality of fastener holes.

6. The top trim panel of claim 1, wherein the residential kitchen appliance is selected from the group consisting of a refrigerator, a refrigerator-freezer, and a stand-alone upright freezer.

* * * * *